United States Patent [19]

Kimura et al.

[11] Patent Number: 4,955,179

[45] Date of Patent: Sep. 11, 1990

[54] COIN WRAPPING PAPER FEEDING APPARATUS FOR COIN WRAPPING MACHINE

[75] Inventors: Hideki Kimura, Matsudo; Shoichi Uda, Tokyo, both of Japan

[73] Assignee: Laurel Bank Machines Co., Ltd., Tokyo, Japan

[21] Appl. No.: 396,646

[22] Filed: Aug. 22, 1989

[30] Foreign Application Priority Data

Aug. 24, 1988 [JP] Japan ..... 63-111025[U]
Aug. 9, 1989 [JP] Japan ..... 1-206015

[51] Int. Cl.[5] ..... B65B 11/04
[52] U.S. Cl. ..... 53/212; 53/389
[58] Field of Search ..... 53/64, 66, 212, 211, 53/389

[56] References Cited

U.S. PATENT DOCUMENTS 4,282,701 8/1981 Miyazaki et al. ..... 53/212 X
4,554,775 11/1985 Asami et al. ..... 53/212 X
4,729,211 3/1988 Sakurai ..... 53/389 X
4,781,010 11/1988 Furuya et al. ..... 53/389 X

FOREIGN PATENT DOCUMENTS 58-112918 7/1983 Japan .
2187162 9/1987 United Kingdom .

*Primary Examiner*—James F. Coan

*Attorney, Agent, or Firm*—Fleit, Jacobson, Cohn, Price, Holman & Stern

[57] ABSTRACT

A coin wrapping paper feeding apparatus for a coin wrapping machine in which coin wrapping paper fed out from a coin wrapping paper storing section is cut by cutter to a predetermined length and the coin wrapping paper is wound around stacked coins by wrapping rollers, thereby to wrap the stacked coins, the coin wrapping paper feeding apparatus including a feed roller disposed between the coin wrapping paper storing section and the cutter for feeding the coin wrapping paper to the cutter, a motor for rotating the feed roller, a wrapping paper holder disposed between the coin wrapping paper storing section and the feed roller and adapted to hold the coin wrapping paper, a rotation number detector for detecting the number of rotations of the feed roller, a preparatory operation start detector for detecting start of preparatory operation for coin wrapping operation and outputting a start signal, and a controller for enabling the motor to start the rotation of the feed roller and enabling the rotation number detector to start the detection of the number of rotations of the feed roller when receiving the start signal, and enabling the motor to stop the rotation of the feed roller when it judges that the number of rotations of the feed roller input from the rotation number detector has reached a predetermined value. In this coin wrapping paper feeding apparatus, it is possible to easily and safely carry out a preparatory operation for coin wrapping operation.

4 Claims, 2 Drawing Sheets

COIN WRAPPING PAPER FEEDING APPARATUS FOR COIN WRAPPING MACHINE

BACKGROUND OF THE INVENTION

The present invention relates to a coin wrapping paper feeding apparatus for a coin wrapping machine, and, more particularly, to such an apparatus capable of easily and safely carrying out preparatory operation prior to starting coin wrapping operation.

DESCRIPTION OF THE PRIOR ART

As disclosed in unexamined Japanese Patent Publication No. 58(1983)-112918 and U.S. Pat. No. 4,729,211, there is known a coin wrapping machine which rotates a feed roller of a coin wrapping paper feeding apparatus, unwinds coin wrapping paper from a roll of coin wrapping paper, feeds the unwound wrapping paper between stacked coins and a plurality of wrapping rollers, stops the rotation of the feed roller when a predetermined length of the coin wrapping paper has been fed, brings the coin wrapping paper into contact with a cutter by a tensile force produced by the rotation of the plurality of wrapping rollers to be cut by the cutter, winds the coin wrapping paper around the stacked coins by the wrapping rollers and crimps the upper and lower ends of the coin wrapping paper.

In this kind of the coin wrapping machine, the leading edge of the coin wrapping paper is always positioned at a position opposite to the edge of the cutter when one cycle of the coin wrapping operation is completed. As a result, since, in the case where the coin wrapping operation is repeated, each cycle of the coin wrapping operation is started in the condition where the leading edge of the coin wrapping paper is positioned at the position opposite to the edge of the cutter, the positions of respective means, the driving timing thereof and the like are set on the assumption that the leading edge of the coin wrapping paper is positioned at the position opposite to the edge of the cutter when the coin wrapping operation is started. Accordingly, in the case where the coin wrapping operation is started, it is indispensable, prior to starting the coin wrapping operation, to feed the coin wrapping paper so that the leading edge of the coin wrapping paper is positioned at the position opposite to the edge of the cutter.

In the prior art coin wrapping machines, such preparatory operation to the start of the coin wrapping operation is carried out manually by an operator by feeding the coin wrapping paper toward the cutter through a portion between a pair of feed rollers, cutting the coin wrapping paper and positioning the leading edge of coin wrapping paper at the position opposite to the edge of the cutter.

However, this preparatory operation is not only very troublesome but also involves some risk of injuring the hands of the operator who positions the leading edge of the coin wrapping paper by manually feeding the coin wrapping paper toward the cutter through the portion between the pair of feed rollers and cutting it.

SUMMARY OF THE INVENTION

It is, therefore, an object of the present invention to provide a coin wrapping paper feeding apparatus for a coin wrapping machine capable of easily and safely positioning the leading edge of coin wrapping paper at a predetermined position prior to starting the coin wrapping operation.

According to the present invention, the above and other objects can be accomplished by a coin wrapping paper feeding apparatus for a coin wrapping machine in which coin wrapping paper fed out from a coin wrapping paper storing section is cut by cutter means to a predetermined length and the coin wrapping paper is wound around stacked coins by wrapping roller means, thereby to wrap the stacked coins, said coin wrapping paper feeding apparatus comprising feed roller means disposed between said coin wrapping paper storing section and said cutter means for feeding the coin wrapping paper to said cutter means, motor means for rotating said feed roller means, wrapping paper holding means disposed between said coin wrapping paper storing section and said feed roller means and adapted to hold the coin wrapping paper, rotation number detecting means for detecting the number of rotations of said feed roller means, preparatory operation start detecting means for detecting start of preparatory operation for coin wrapping operation and outputting a start signal, and control means for enabling said motor means to start the rotation of said feed roller means and enabling said rotation number detecting means to start the detection of the number of rotations of said feed roller means when receiving the start signal, and enabling the motor means to stop the rotation of said feed roller means when it judges that the number of rotations of the feed roller means input from said rotation number detecting means has reached a predetermined value.

In a preferred aspect of the present invention, said packing paper holding means comprises a guide roller and a plate biased toward said guide roller so as to press its circumference.

In a further preferred aspect of the present invention, said feed roller means comprises a feed roller and a driven roller biased toward said feed roller so as to press its circumference and rotatable together with said feed roller.

The above and other objects and features of the present invention will become apparent from the following description made with reference to the accompanying drawings.

DESCRIPTION OF THE PREFERRED EMBODIMENTS

Figure 1:
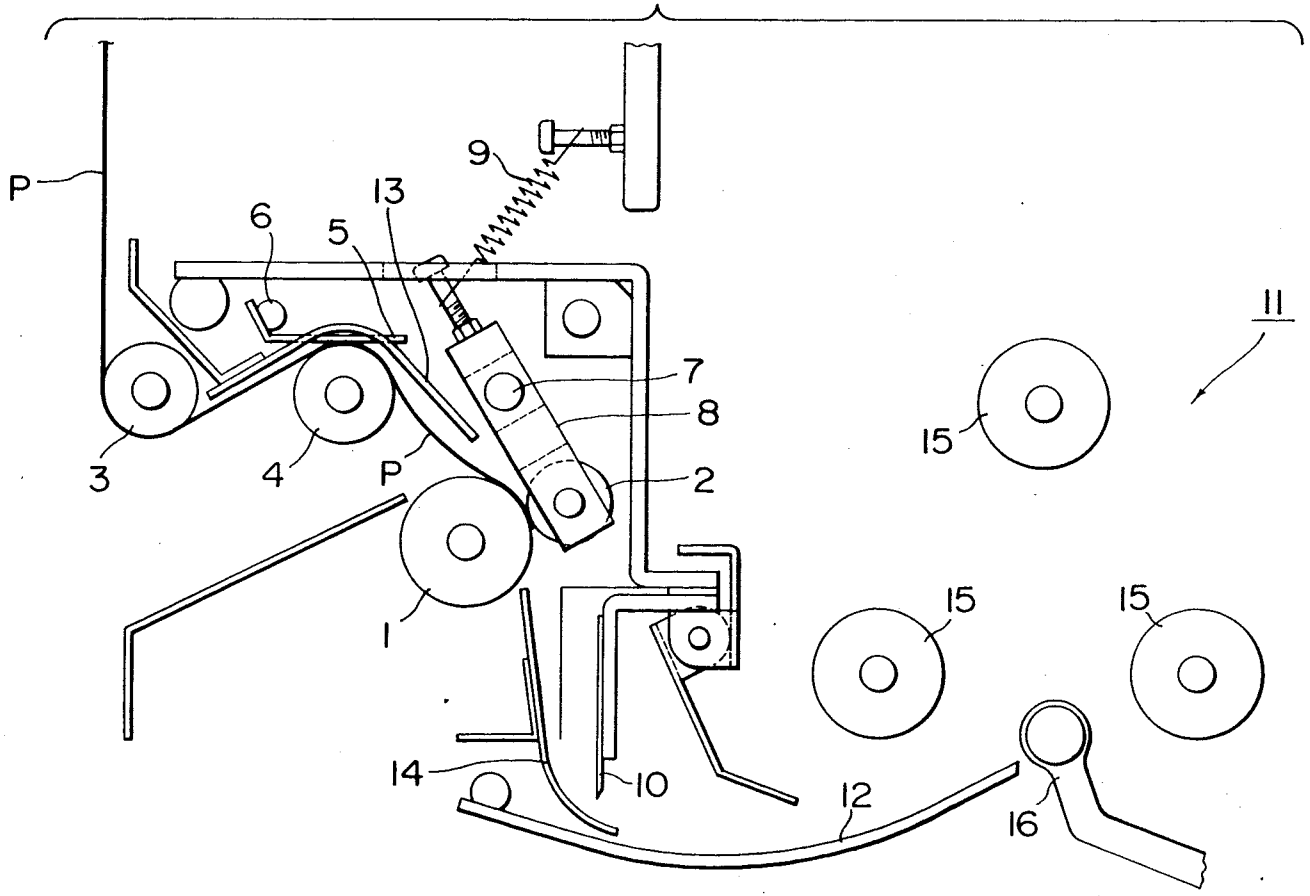
FIG. 1 is a schematic drawing showing a plan view of a coin wrapping paper feeding apparatus which is an embodiment of the present invention.

Referring to FIG. 1, a coin wrapping paper feeding apparatus which is an embodiment of the present invention is provided with a feed roller 1 driven by a motor (not shown) and a driven roller 2 rotatable together with the feed roller 1. Coin wrapping paper P rolled and stored in a coin wrapping paper storing section (not shown) is fed to a portion between the feed roller 1 and the driven roller 2, while being guided by a first guide roller 3 and a second feed roller 4.

In the vicinity of the second guide roller 4, a press plate 5 is pivotably mounted on a shaft 6 and biased toward the second guide roller 4, and during feed of the coin wrapping paper P, the coin wrapping paper P is held between the second guide roller 4 and the press plate 5.

The driven roller 2 is rotatably mounted on one end portion of a support member 8 swingably mounted on a shaft 7. One end of a tension spring 9 is fixed to the other end portion of the support member 8 and the other end thereof is fixed to the body of the coin wrapping machine. As a result, the support member 8 is biased clockwise in FIG. 1 and, therefore, the driven roller 2 is biased toward the feed roller 1, whereby the feed roller 1 and the driven roller 2 are able to feed the coin wrapping paper P to a cutter 10 and a wrapping mechanism 11, while holding the coin wrapping paper P therebetween.

The cutter 10 is disposed so that the edge thereof faces downwardly in FIG. 1 and a guide plate 12 is provided for guiding and feeding the coin wrapping paper P to the wrapping mechanism 11 below the edge of the cutter 10 in FIG. 1. Further, a guide plate 13 is provided between the first guide roller 3 and the feed roller 1, and a guide plate 14 is provided between the feed roller 1, the driven roller 2 and the cutter 10.

The wrapping mechanism comprises three wrapping rollers 15, 15, 15 and a support bar 16, similarly to the prior art coin wrapping machine.

Coins stacked by a coin stacking mechanism (not shown) are received by an upper face of the support bar 16 and the coin wrapping operation is started after the support bar 16 has been moved among the wrapping rollers 15, 15, 15.

The rotation of the feed roller 1 is controlled so as to be stopped after a predetermined length of the coin wrapping paper P has been fed to the wrapping rollers 15, 15, 15. After the rotation of the feed roller 1 is stopped, the coin wrapping paper P is wound around the stacked coins by rotating the wrapping rollers 15, 15, 15 and when a predetermined length of the coin wrapping paper P has been wound around the stacked coins, the coin wrapping paper P comes into contact with the cutter 10 by a tensile force produced by the feed roller 1, the driven roller 2 and the wrapping rollers 15, 15, 15 and is cut by the cutter 10. The positional relationship among the feed roller 1, driven roller 2, the cutter 10 and the wrapping rollers 15, 15, 15 is determined so that the above described operation can be accomplished.

Figure 2:
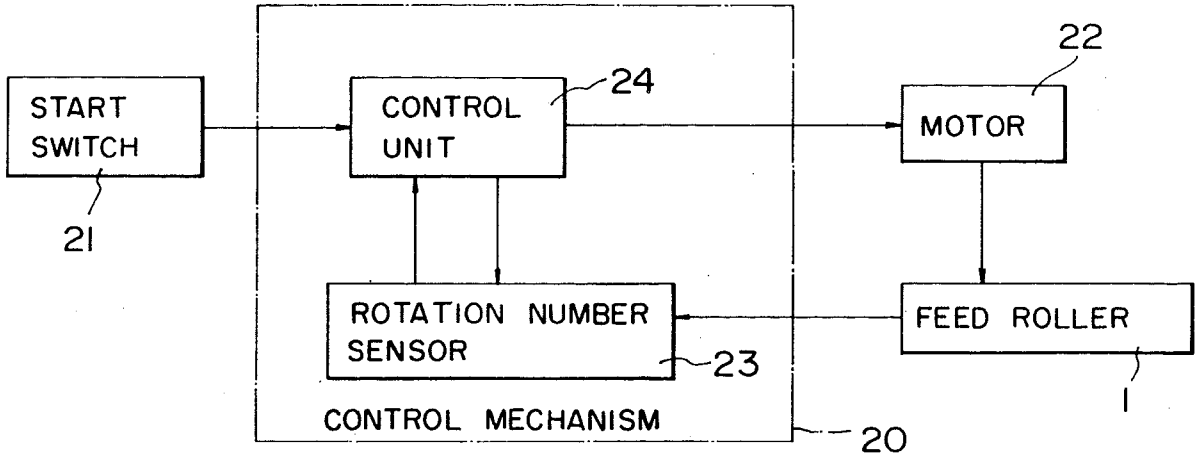
FIG. 2 is a block diagram of a control mechanism for controlling preparatory operation for coin wrapping operation.

FIG. 2 is a block diagram of a control mechanism for controlling the preparatory operation for the coin wrapping operation.

Referring to FIG. 2, the control mechanism 20 for the preparatory operation for the coin wrapping operation is provided with a control unit 24 which outputs a drive signal to the motor 22 to enable it to rotate the feed roller 1 and a detection start signal to a rotation number sensor 23 to enable it to detect the number of rotation of the feed roller 1, when a start signal is input from a start switch 21 operated by an operator The control unit 24 stores the number of rotations of the feed roller 1 required for feeding the leading edge of the coin wrapping paper P from the feed roller 1 to position opposite to the edge of the cutter 10 and when it judges based upon a rotation number detection signal input from the rotation number sensor 23 that the feed roller 1 has rotated by the number of rotations equal to the stored number of rotations after the start switch 21 was turned on, the control unit 24 outputs a drive stop signal to the motor 22, thereby to enable it to stop the rotation of the feed roller 1.

In the thus constituted coin wrapping paper feeding apparatus for the coin wrapping machine which is an embodiment of the present invention, prior to starting the coin wrapping operation, the operator takes out the coin wrapping paper P rolled and stored in the coin wrapping paper storing section (not shown) via the first guide roller 3 and the second guide roller 4, and causes the leading edge thereof to abut against a portion between the feed roller 1 and the driven roller 2. In this state, since the coin wrapping roller P is held between the second roller 4 and the press plate 5 upstream of the feed roller 1 and the driven roller 2, the leading edge of the coin wrapping paper P which has abutted against the portion between the feed roller 1 and the driven roller 2 can be prevented from retracting toward the coin wrapping paper storing section, whereby it is possible to easily hold the leading edge of the coin wrapping paper P between the feed roller 1 and the driven roller 2 without fail.

Afterward, when the operator turns the start switch 21 on, the start signal is input to the control unit 24. The control unit 24 outputs the drive signal to the motor 22 and enables the motor 22 to rotate the feed roller 1 clockwise in FIG. 1. Simultaneously, the control unit 24 outputs the detection start signal to the rotation number sensor 23 and enables it to detect the number of rotations of the feed roller 1.

Thus, in the case where the feed roller 1 is rotated clockwise in FIG. 1, the driven roller 2 is rotated counterclockwise in accordance with the rotation of the feed roller 1 and the leading edge of the coin wrapping paper P held between the feed roller 1 and the driven roller 2 is fed toward the cutter 10 by the feed roller 1 and the driven roller 2.

The leading edge of the coin wrapping paper P fed from the feed roller 1 and the driver roller 2 is further fed by the feed roller 1, while being guided by the guide plate 14 and reaches the position opposite to the edge of the cutter 10.

As described above, the control unit 24 stores the number of rotations of the feed roller 1 required for feeding the leading edge of the coin wrapping paper P from the feed roller 1 and the driven roller 2 to the position opposite to the edge of the cutter 10 and when it judges based upon the rotation number detection signal input from the rotation number sensor 23 that the feed roller 1 has rotated by a predetermined number of rotations stored therein, the control unit 24 outputs the drive stop signal to the motor 22, thereby to enable it to stop the rotation of the feed roller 1.

Accordingly, the coin wrapping paper P is stopped so that the leading edge thereof is positioned opposite to the edge of the cutter 10 and the preparatory operation for the coin wrapping operation is completed.

According to this embodiment, since the coin wrapping paper P is automatically fed and stopped without fail only by causing the leading edge of the coin wrapping paper P to abut against the portion between the feed roller 1 and the driven roller 2 manually so that the leading edge of the coin wrapping paper P is positioned opposite to the edge of the cutter 10, there is no risk of injuring the hands of the operator and the preparatory operation for the coin wrapping operation can be easily and safely completed.

As described in detail with reference to the preferred embodiment, according to the present invention, it is possible to provide a coin wrapping paper feeding apparatus for a coin wrapping machine capable of easily and safely carrying out the preparatory operation for the coin wrapping operation.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the second guide roller 4 and the press plate 5 are provided for preventing the leading edge of the coin wrapping paper P which has abutted against the portion between the feed roller 1 and the driven roller 2 from retracting toward the coin wrapping paper storing section, it is possible to provide a roller rotatable only counterclockwise in FIG. 1 in place of the press plate 5 for preventing the leading edge of the coin wrapping paper from retracting toward the coin wrapping paper storing section.

We claim:

1. A coin wrapping paper feeding apparatus for a coin wrapping machine in which coin wrapping paper fed out from a coin wrapping paper storing section is cut by cutter means to a predetermined length and the coin wrapping paper is wound around stacked coins by wrapping roller means, thereby to wrap the stacked coins, said coin wrapping paper feeding apparatus comprising feed roller means disposed between said coin wrapping paper storing section and said cutter means for feeding the coin wrapping paper to said cutter means along a path of travel, motor means for rotating said feed roller means, wrapping paper holding means disposed between said coin wrapping paper storing section and said feed roller means along the path of travel with said wrapping paper holding means being located upstream from said feed roller means and said wrapping paper holding means being adapted to hold the coin wrapping paper, rotation number detecting means for detecting the number of rotations of said feed roller means, preparatory operation start detecting means for detecting start of a preparatory operation for a coin wrapping operation and outputting a start signal, and control means for enabling said motor means to start the rotation of said feed roller means and enabling said rotation number detecting means to start the detection of the number of rotations of said feed roller means when receiving the start signal, and enabling the motor means to stop the rotation of said feed roller means when said control means judges that the number of rotations of the feed roller means input from said rotation number detecting means has reached a predetermined value.

2. A coin wrapping paper feeding apparatus in accordance with claim 1 wherein said wrapping paper holding means comprises a guide roller and a plate biased toward said guide roller so as to press its circumference.

3. A coin wrapping paper feeding apparatus in accordance with claim 1 wherein said feed roller means comprises a feed roller and a driven roller biased toward said feed roller so as to press its circumference and rotatable together with said feed roller.

4. A coin wrapping paper feeding apparatus in accordance with claim 2 wherein said feed roller means comprises a feed roller and a driven roller biased toward said feed roller so as to press its circumference and rotatable together with said feed roller.

* * * * *